US008510963B2

(12) United States Patent
Kraljevic

(10) Patent No.: US 8,510,963 B2
(45) Date of Patent: Aug. 20, 2013

(54) CONTOUR TRACING TOOL

(76) Inventor: Vladimir Kraljevic, Pickering (CA)

( * ) Notice: Subject to any disclaimer, the term of this patent is extended or adjusted under 35 U.S.C. 154(b) by 218 days.

(21) Appl. No.: 13/210,537

(22) Filed: Aug. 16, 2011

(65) Prior Publication Data

US 2013/0042488 A1 Feb. 21, 2013

(51) Int. Cl.
*B43L 13/02* (2006.01)
*B25H 7/04* (2006.01)

(52) U.S. Cl.
USPC ..... 33/21.1; 33/41.6; 33/42; 33/526

(58) Field of Classification Search
USPC ..... 33/21.1, 1 G, 27.01, 41.1, 41.4, 41.6, 33/526, 527
See application file for complete search history.

(56) References Cited

U.S. PATENT DOCUMENTS 3,875,664 A * 4/1975 Diner ..... 30/164.9
4,099,552 A * 7/1978 Dyball ..... 144/154.5
4,388,761 A * 6/1983 Henderson ..... 33/42
4,577,415 A * 3/1986 Schiller ..... 33/430
5,103,566 A * 4/1992 Stebe ..... 33/42
5,651,184 A * 7/1997 Tutty ..... 33/21.1
5,737,844 A * 4/1998 Brumley ..... 33/194
6,804,890 B1 * 10/2004 Kennedy, Sr. ..... 33/21.3
7,040,035 B1 * 5/2006 Scarborough ..... 33/668
7,194,810 B2 * 3/2007 Shai ..... 33/42
7,451,547 B1 * 11/2008 Lantinen ..... 33/42
7,481,001 B1 * 1/2009 Rao ..... 33/42
8,001,695 B2 * 8/2011 Watters ..... 33/42

* cited by examiner

*Primary Examiner* — Christopher Fulton
(74) *Attorney, Agent, or Firm* — Elias Borges

(57) ABSTRACT

A tool for tracing a curve from a first plane (such as a wall) onto a second plane perpendicular to the first plane (such as a floor tile) is disclosed. The tool includes a base member having opposite first and second ends with first and second sliders positioned on the base member adjacent the first and second ends, respectively. The sliders are configured to bear against the first plane simultaneously. The tool also includes an arm extending away from the base member with a marking tool positioned at an end of the arm opposite the base member. The marking tool is configured to mark the second plane while the first and second sliders bear against the first plane. The base member is preferably articulated and each of the sliders preferably consist of pairs of coaxially aligned wheels.

9 Claims, 4 Drawing Sheets

CONTOUR TRACING TOOL

FIELD OF THE INVENTION

The invention relates generally to tracing and scribing tools for tracing the contour of a vertical surface onto a horizontal surface.

BACKGROUND OF THE INVENTION

Finishing floors around a curved section of wall or around a curved section of stair case can be a frustrating exercise. Fitting the tiles or flooring to correctly match the curve of the wall or stair case often requires several attempts and several cuts until the correct radius of the curve is found. Usually, the worker simply tries to match the curve by eye and traces what he or she thinks is the correct curve on the flooring, then cuts the flooring. The worker then tries to fit the cut flooring to the curved section of wall or stair case, only to find that the cut flooring does not accurately match the curve section of wall or stair case. Another cut is attempted and then test fit. The process is repeated until the correct curve is traced and cut.

Over the years, various scribing tools have been used to help a worker trace out a curve. These scribing tools, while generally good enough to trace a curve having a known radius, are generally not able to correctly trace a curved structure accurately. An improved scribing and tracing tool is therefore required.

SUMMARY OF THE INVENTION

In accordance with one aspect of the present invention, there is provided a tool for tracing a curve from a first plane (such as a wall) onto a second plane perpendicular to the first plane (such as a floor tile). The tool includes a base member having opposite first and second ends with first and second sliders positioned on the base member adjacent the first and second ends, respectively. The sliders are configured to bear against the first plane simultaneously. The tool also includes an arm extending away from the base member with a marking tool positioned at an end of the arm opposite the base member. The marking tool is configured to mark the second plane while the first and second sliders bear against the first plane.

In accordance with another aspect of the present invention, there is provided a tool for tracing a curve from a first plane onto a second plane perpendicular to the first plane. The tool includes a frame having first and second arms mounted to an elongated base member. The base member has opposite first and second ends and each arm has opposite first and second ends. The first ends of the first and second arms are coupled together at a first joint. The first end of the base member is coupled to the second end of the first arm at a second joint and the second end of the base member is coupled to the second end of the second arm at a third joint. First and second sliders are mounted to the base member adjacent the first and second ends of the third arm, respectively. The first and second sliders are configured to simultaneously bear against the first plane. The tool also includes a marking tool positioned on the frame adjacent the first joint, the marking tool configured to mark on the second plane while the first and second sliders bear against the first plane.

With the foregoing in view, and other advantages as will become apparent to those skilled in the art to which this invention relates as this specification proceeds, the invention is herein described by reference to the accompanying drawings forming a part hereof, which includes a description of the preferred typical embodiment of the principles of the present invention.

DESCRIPTION OF THE DRAWINGS

In the drawings like characters of reference indicate corresponding parts in the different figures.

DETAILED DESCRIPTION OF THE INVENTION

Figure 1:
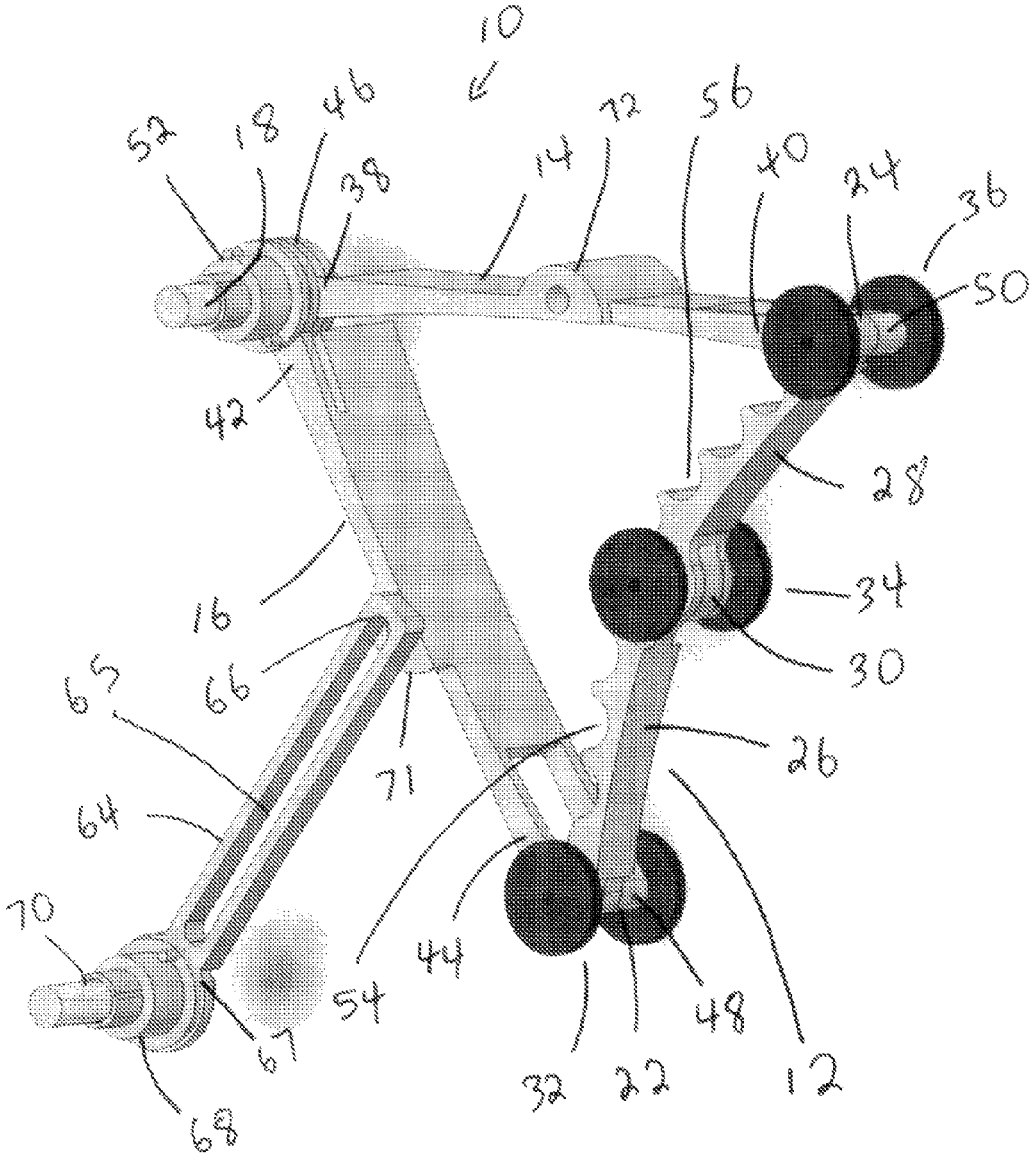
FIG. 1 is a perspective view of a marking tool made in accordance with the present invention showing an additional marker coupled to the main frame of the marking tool.

Referring to FIG. 1, a marking tool made in accordance with the present invention is shown generally as item 10 and consists of a base member 12, arms 14 and 16 and marking tool (marker) 18. Base member 12 has opposite first and second ends 22 and 24, respectively. Base member 12 is articulated into two sub members 26 and 28 which are pivotally coupled together by joint 30. Joint 30 is located midway between ends 22 and 24. Sliders 32, 34 and 36 are mounted on member 12 adjacent end 22, joint 30 and end 24, respectively. Arm 14 has opposite ends 38 and 40, and arm 16 has opposite ends 42 and 44. Ends 38 and 42 of arms 14 and 16, respectively, are pivotally connected to each other by joint 46. End 44 of arm 16 is pivotally coupled to end 22 of base member 12 by joint 48 and end 40 of arm 14 is pivotally coupled to end 24 of the base member by joint 50. Joints 50, 48, 46 and 30 are all hinge joints which are configured to permit their respective arms and sub-members to pivot relative to each other in only one plane. By permitting pivotal movement in only one plane, the marking tool 10 is less prone to wobbling.

Sliders 32, 34 and 36 each consist of a pair of coaxially aligned wheels positioned on either side of a joint. The wheels provide a low friction means of sliding base member 12 along a plane. Alternatively, the sliders may consist of runners made from a low friction material such as Teflon™. Wheels are preferred since there is less chance that they will accidentally leave marks on the wall or surface they bear against. Coaxially aligned pairs of wheels are preferred since they permit the base member to more securely bear against a wall or surface without wobbling.

Base member 12 is provided with indentations 54 and 56 which are configured to retain a user's fingers (not shown) so as to permit the use to firmly press base member 12 towards a wall or surface. Indentations 54 and 56 make it less likely that the marking tool will slip or wobble while the user uses the tool to trace the curve of a surface.

Figure 2:
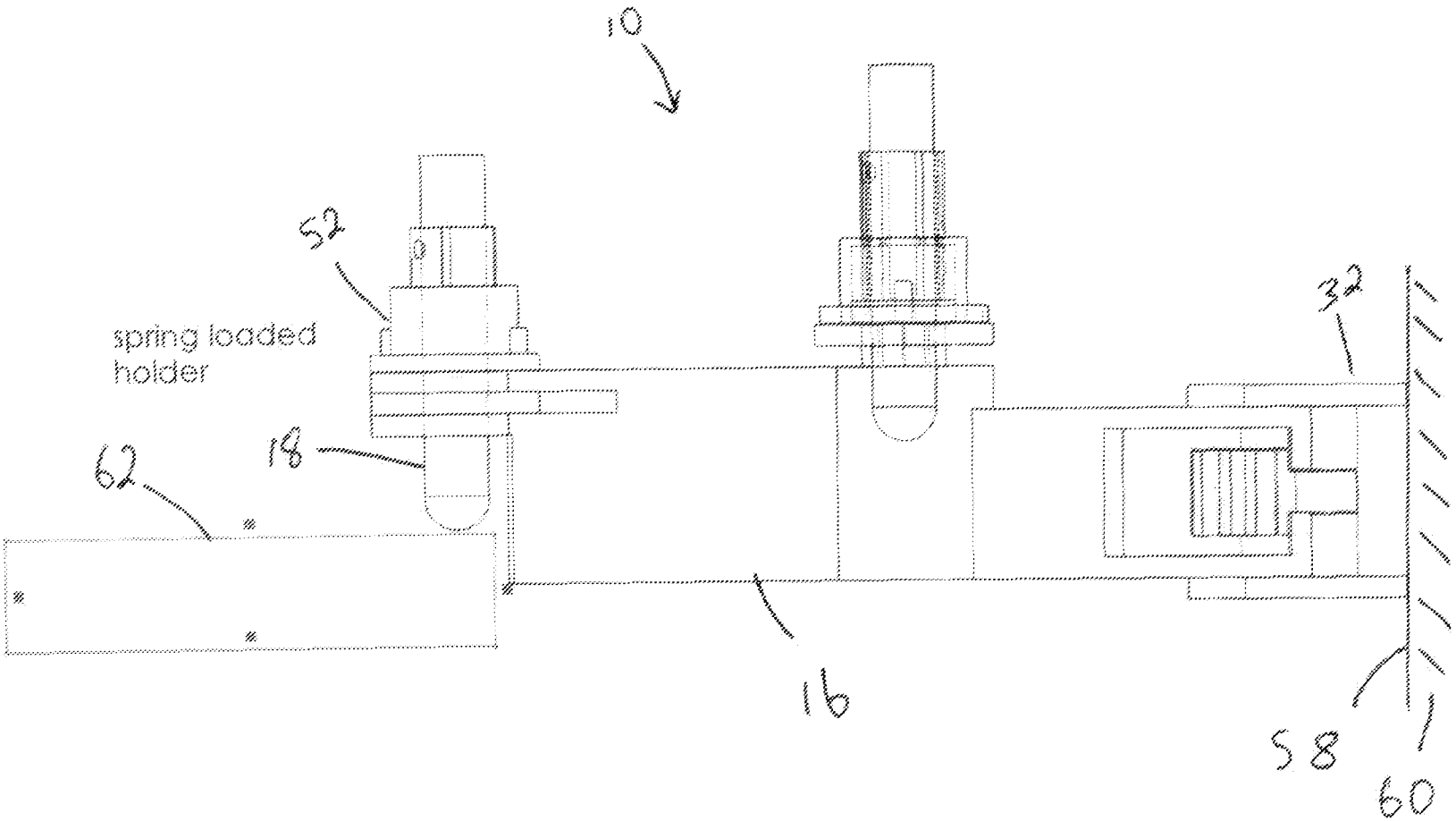
FIG. 2 is a side view of the marking tool shown in FIG. 1.

Marker 18 consists of a pen, pencil, caulk, wax crayon or other device for making a mark on a surface. Marker 18 is held in a marker holder 52 which consists of a tubular opening configured to receive the marking tool. As seen in FIG. 2, marker holder 52 is configured to hold marker 18 parallel to surface (plane) 58 of wall section 60. Holder 52 further positions marker 18 such that the marker can lay down a line (mark) onto plane 62 (such as a section of flooring) which is positioned perpendicular to wall section 60. Preferably holder 52 is spring loaded to bias marker 18 towards plane 62 and ensures good contact between the marker and plane 62.

Referring back to FIG. 1, marking tool 10 may also be provided with supplementary arm 64 which is pivotally coupled to either arm 16 or 14 at attachment points 71 and 72, respectively. Arm 64 has an elongated slot 65 formed therein and extending the entire length of the arm between ends 66 and 67. Slot 65 allows arm 64 to be mounted to attachment points 71 or 72 at any point along the length of the arm by means of a screw (not shown). At end 67 of arm 64 is a marker holder 68 which is configured to hold marker 70. Arm 64 enables a user to mark a tile or other type of flooring which is positioned away from marker 18.

Figure 3:
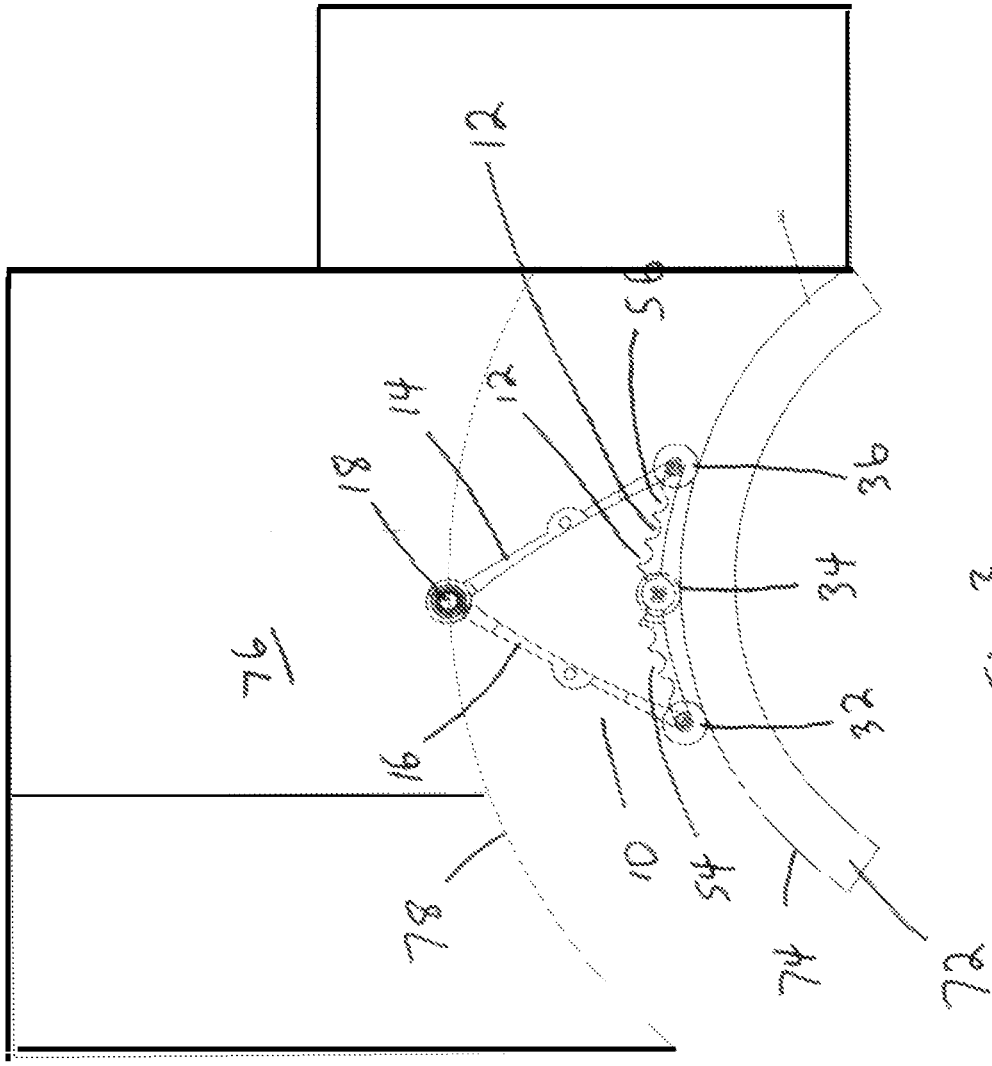
FIG. 3 is a top view of a marking tool made in accordance with the present invention being used to trace the curve of a convex wall section onto a section of flooring lying adjacent the wall section.

Referring now to FIG. 3, the use of the marking tool made in accordance with the invention to trace the curve of an outwardly curved (convex) wall will now be explained. Marking tool 10 is placed on a flat plane 76 such as a floor upon which a paper sheet or a section of flooring has been laid down. Marking tool 10 is positioned such that base member 12 is oriented towards curved wall 72 and sliders 32, 34 and 36 bear against curved surface 74 of wall 72. Since base member 12 is articulated, it can assume a shape which permits the wheels of sliders 32, 34 and 36 to all bear against surface 74 simultaneously. The user can use indentations 54 and 56 to help him/her position the marking tool firmly against wall 72. Arms 16 and 14 position marker 18 away from wall 72 such that the marker lays down trace 78 onto plane 76 as tool 10 is moved along wall 72. In this way, tool 10 accurately traces the curve of wall 72 onto plane 76 as trace 78.

Figure 4:
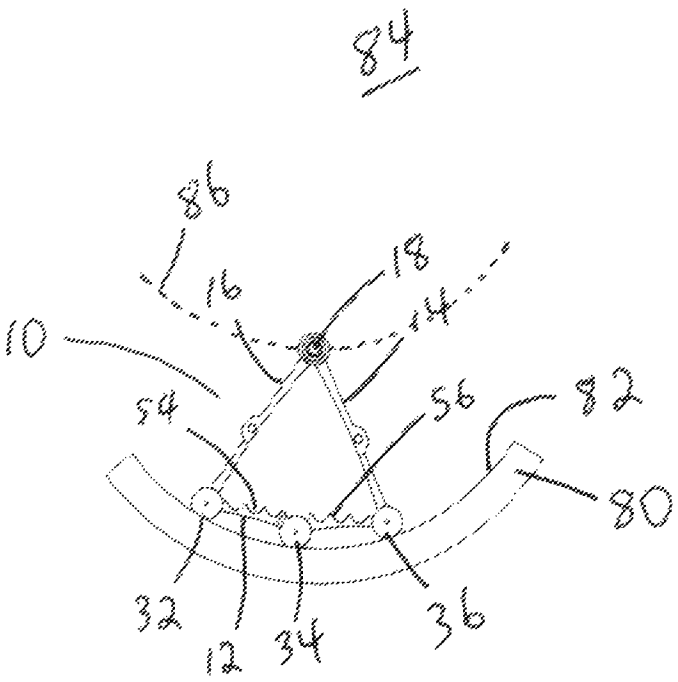
FIG. 4 is a top view of a marking tool made in accordance with the present invention being used to trace the curve of a concave wall section onto a section of flooring lying adjacent the wall section.

Referring now to FIG. 4, the use of the marking tool made in accordance with the invention to trace the curve of an inwardly curved (concave) wall will now be explained. Marking tool 10 is placed on a flat plane 84 such as a floor upon which a paper sheet or a section of flooring has been laid down. Marking tool 10 is positioned such that base member 12 is oriented towards curved wall 80 and sliders 32, 34 and 36 bear against curved surface 82 of the wall. Since base member 12 is articulated, it can assume a shape which permits the wheels of sliders 32, 34 and 36 to all bear against surface 82 simultaneously. It will be appreciated that middle slider 34 would not be able to contact surface 82 unless base member 12 could move because it is articulated. By keeping all the wheels/sliders bearing against surface 82, tool 10 can trace the curve accurately without missing any portion of the curved surface. The user can use indentations 54 and 56 to help him/her position the marking tool firmly against wall 80. Arms 16 and 14 position marker 18 away from wall 80 such that the marker lays down trace 86 onto plane 84 as tool 10 is moved along wall 80. In this way, tool 10 accurately traces the curve of wall 80 onto plane 84 as trace 86.

A specific embodiment of the present invention has been disclosed; however, several variations of the disclosed embodiment could be envisioned as within the scope of this invention. It is to be understood that the present invention is not limited to the embodiments described above, but encompasses any and all embodiments within the scope of the following claims Therefore, what is claimed is:

1. A tool for tracing a curve from a first plane onto a second plane perpendicular to the first plane, the tool comprising:

a. A frame having first and second arms and an elongated base member, the base member having opposite first and second ends and each arm having opposite first and second ends, the first ends of the first and second arms being coupled together at a first joint; the first end of the base member being coupled to the second end of the first arm at a second joint and the second end of the base member being coupled to the second end of the second arm at a third joint;

b. First and second sliders mounted to the base member adjacent the first and second ends of the base member, the first and second sliders being configured to simultaneously bear against the first plane;

c. a marking tool positioned on the frame adjacent the first joint, the marking tool configured to mark on the second plane while the first and second sliders bear against the first plane, and d. wherein the base member is articulated into two sub-members joined together by a forth joint formed midway between the first and second ends of the base member, the first, second, third and forth joints being pivotal joints allowing their respective arms and sub-members to pivotally move in the same plane only.

2. The tool defined in claim 1 wherein a third slider is positioned on the base member adjacent the forth joint, the third slider configured to bear against the first plane simultaneously with the first and second sliders.

3. The tool defined in claim 2 wherein the first, second and third sliders each comprise a pair of wheels.

4. The tool defined in claim 1 wherein the first and second sliders each comprise a pair of wheels.

5. The tool defined in claim 1 wherein the third arm has a plurality of indentations for receiving a user's fingers, the indentations configured to permit the user to force the third arm against the first plane.

6. A tool for tracing a curve from a first plane onto a second plane perpendicular to the first plane, the tool comprising:

a. A base member having opposite first and second ends;

b. First and second sliders positioned on the base member adjacent the first and second ends, respectively, the sliders configured to bear against the first plane simultaneously;

c. An arm extending away from the base member with a marking tool positioned at an end of the arm opposite the base member, the marking tool configured to mark the second plane while the first and second sliders bear against the first plane;

d. wherein the base member is articulated into two sub-base members pivotally connected together at a joint positioned mid way between the first and second ends of the base member, and e. wherein the arm is articulated into a pair of arms pivotally coupled together, one of said pair of arms pivotally coupled to the base member adjacent the first end and the other of said pair of arms pivotally coupled to the base member adjacent the second end of the base member, the sub-base members and pair of arms being pivotally movable in the same plane only.

7. The tool defined in claim 6 further comprising a third slider positioned on the base member adjacent the joint, the third slider configured to bear against the first plane simultaneously with the first and second sliders.

8. The tool defined in claim 7 wherein the first, second and third sliders each comprise a pair of wheels.

9. The tool defined in claim 6 wherein the first and second sliders each comprise a pair of wheels.

* * * * *